US005601910A

United States Patent [19]

Murphy et al.

[11] Patent Number: 5,601,910

[45] Date of Patent: Feb. 11, 1997

[54] RUG UNDERLAY SUBSTANTIALLY IMPERVIOUS TO LIQUIDS

[75] Inventors: Peter M. Murphy, Ooltewah, Tenn.; Edward J. Greenwood, Hockessin, Del.

[73] Assignee: E. I. Du Pont de Nemours and Company, Wilmington, Del.

[21] Appl. No.: 424,754

[22] Filed: Apr. 18, 1995

[51] Int. Cl.[6] ..... B32B 27/00

[52] U.S. Cl. ..... 442/79; 428/343; 428/354; 427/393.4; 442/80; 442/81; 442/82; 442/84

[58] Field of Search ..... 428/288, 290, 428/343, 354; 427/393.4

[56] References Cited

U.S. PATENT DOCUMENTS

| | | | |
|---|---|---|---|
| 3,923,715 | 12/1975 | Dettre et al. | 260/29.6 |
| 4,014,645 | 3/1977 | Chancler et al. | 8/17 |
| 4,029,585 | 6/1977 | Dettre et al. | 252/8.6 |
| 4,595,518 | 6/1986 | Raynolds et al. | 252/8.6 |
| 4,742,140 | 5/1988 | Greenwood et al. | 526/245 |
| 4,958,039 | 9/1990 | Pechhold | 556/421 |
| 5,348,785 | 9/1994 | Vinod | 428/95 |

*Primary Examiner*—Christopher Raimund

[57] ABSTRACT

A carpet underlay comprising a fibrous non-woven substrate composed of natural or synthetic fibers having in or on it a repellent finish which makes said substrate substantially impervious to liquids.

14 Claims, No Drawings

RUG UNDERLAY SUBSTANTIALLY IMPERVIOUS TO LIQUIDS

FIELD OF THE INVENTION

This invention relates to novel rug underlays that are substantially impervious to liquids.

BACKGROUND OF THE INVENTION

Area rugs, for instance Oriental rugs, are commonly laid over wall-to-wall carpeting or other carpets, or over decorative wood flooring, to achieve desired esthetic effects. When such rugs are laid over carpets the rug may tend to slip or move in one direction due to the alternating compression and release of the fibers in the underlying carpet caused by normal traffic. Thus the rug and furnishings placed on it move from their desired position. Additionally the rug may become creased or wrinkled instead of flat. Such rugs may also slip on the polished surfaces of a decorative wood floor. Such movements detract from the esthetics of the room and may cause slipping and tripping risks.

Rug underlays have been proposed as a solution to such problems, for instance the rug underlays disclosed by Mussallem in U.S. Pat. No. 4,504,538 and U.S. Pat. No. 4,985,279. The underlay typically consists of a light-weight non-woven mat, comprised of filamentary fibers, needle-punched into a coarse thin mat. Needle-punching is commonly used to compress fibrous mats into a felt-like material. Mussallem discloses that any natural or synthetic fiber may be used in the underlay, but that synthetic fibers such as polyolefin, nylon, polyester, acrylic polymers, etc., are preferred. Needle-punching can also be used to embed a woven mesh in such a non-woven mat to strengthen and stiffen the mat. The needle-punched mat is then treated with an emulsion adhesive, such as a synthetic rubber latex, on at least one side and preferably both sides. The adhesive is then cured. The adhesive properties of the underlay effectively secures it to the underlying rug or underlying surface and prevents movement. The underlay adhesive coating is selected to provide both the necessary adhesive strength to prevent slippage or movement and a sufficiently low peel strength so that the rug may be easily and reversibly removed from the underlying surface for cleaning or other purposes.

The prior art discloses a method to render the secondary backing of a carpet substantially impervious to liquids by treatment with repellent compositions, such as fluorochemicals, silicone-based compositions, oils, waxes, and/or hydrophobic acrylate resins. Typically area and Oriental rugs are not treated by such processes and are therefore permeable to liquids.

If water-based or oil-based liquids are spilled on a rug placed over a carpet or decorative wood floor, the underlying material may become stained and deteriorate. Water-based spills may also transfer dyes from the rug to the underlying material. Other water-based spills may contain colored materials, e.g., colored drinks or coffee, or contain other undesirable components, e.g., urine, which can soak through to the underlying material. Oil-based liquids, e.g., mineral oil, baby oil, kerosene, or alcohol, may penetrate to the underlying material with potential undesirable effects. Cleaning aids applied to the rug may similarly pass through the rug and adversely affect the underlying material. Oil-in-water emulsions, e.g., milk or lotions, and water-in-oil emulsions, e.g., dairy spreads, are examples of spills requiring a barrier substantially and simultaneously impervious to both water-based and oil-based spills.

It would be desirable if a treatment could be applied to the underlay which would create a substantially impervious barrier to liquids between the rug and the underlying material. Such a treatment must not interfere with the adhesive surfaces of the underlay, and ideally would be readily incorporated into the manufacturing process for the underlay.

SUMMARY OF THE INVENTION

This invention relates to rug or carpet underlays which are substantially impervious to liquids, such as oil and/or water, and methods of preparing the same. The underlays are also oil-repellent and/or water-repellent.

DETAILED DESCRIPTION OF THE INVENTION

This invention provides underlays with one or more adhesive surfaces having repellent finishes, whereby the underlays are substantially impervious to oil-based and/or water-based liquids. The process of this invention for making the underlay liquid impervious is readily incorporated into the manufacturing processes for underlays.

The term "repellent finish", as used herein, means a composition containing oil- and/or water-repellent chemicals dispersed, dissolved, or suspended in a solvent such as water or alcohol which will form a film-like barrier on or in the underlay to render the same substantially impervious to liquids. The repellent finish may also contain surfactants, foaming agents, and other additives. In addition the repellent finish may also contain a mixture of different repellents. Suitable repellents for use in the repellent finish may be selected from the group consisting of fluorochemicals, silicone compositions, wax emulsions, naturally-occurring oils, hydrophobic alkylacrylate resins, and hydrophobic alkylmethacrylates resins. By the term "liquids" is meant oil-based and/or water-based liquids. By the phrase "substantially impervious to oil-based liquids" is meant that, in addition to being substantially impervious to water, non-aqueous liquids (e.g., mineral oil or alcohol) will not substantially penetrate through the underlay in accordance with the Test Method 1 described below. By the phrase "substantially impervious to water" is meant that water or aqueous solutions or aqueous suspensions (e.g., coffee, wine, soda, fruit juices, or urine) will not substantially penetrate through the underlay in accordance with the Test Method 2 described below.

Generally the mat for the underlay of this invention may be prepared by conventional techniques. The underlay typically consists of a light-weight non-woven mat, comprised of filamentary fibers, and may be needle-punched into a coarse thin mat. Any natural or synthetic fiber may be used to make the underlay, but synthetic fibers such as polyolefin, nylon, polyester, acrylic polymers, etc., are preferred. Optionally a woven mesh may be incorporated into the mat. Such methods and materials are well known to those skilled in the art. While the underlay mat has been described with respect to certain embodiments, many modifications and changes may be made by those skilled in the art. Similarly many methods for the continuous production of underlay and the coating of the underlay are well known to those skilled in the art. It is intended that all such modifications and production methods are included in the meaning of the term "underlay mat" as used herein.

Suitable fluorochemicals include, but are not limited to, polymers or other compounds with molecular weight greater than 500 having pendent or terminal groups of perfluoroalkyl moieties. Examples of some suitable fluorochemicals include: polymers and copolymers of vinylidene fluoride, tetrafluoroethylene, perfluoroalkylethyl acrylates, perfluoroalkylethyl methacrylates, mixtures of the same; blends of the foregoing compounds, polymers and copolymers with: polymers and copolymers of alkyl acrylates and alkylmethacrylates, copolymers of vinylidene chloride, and wax emulsions.

Many commercially available fluorochemicals can be used both as repellent finishes and as effective oil-repellents and water-repellents including, but not limited to, commercially available proprietary products sold under the tradenames of "Teflon"® and "Zonyl"® from DuPont, "Milease"® from ICI, "Asahigard"® from Asahi, "Scotchgard"® from 3M, "Softech"® from Dyetech, "Tex-Tel"® from Atochem, and "NK Guard"® from Nicca may be used. Suitable commercially available silicone-based repellents include, but are not limited to, C2-0563 from Dow Corning. Dow Corning C2-0563 is a silicone repellent mixture of polydialkylsiloxanes. Suitable commercially available wax emulsions include, but are not limited to those sold under the trademark "Nalan"® from DuPont, and "Octowax"® 312 from Tiarco Chemical Co. Suitable hydrophobic acrylate resins include water-repellent polymers and copolymers of acrylic acid esters and methacrylic acid esters such as the methyl, but preferably ethyl and butyl, esters. Mixtures of these polymers and copolymers are also effective. One example of a commercially available resin is "Acrylic Matte Medium" from Golden Artist Colors.

Certain repellent finishes as used in this invention provide an underlay that is substantially impervious to water-based spills. Other repellent finishes provide an underlay that is substantially impervious to liquid spills, including both oil-based and water-based spills. Thus the repellent finish can be selected based on the desired type of imperviousness. Since the repellent finishes for water are typically less expensive than those for liquids, selecting a repellent finish that provides an underlay substantially impervious only to water based spills can be preferred for certain environment.

Preferred fluorochemical repellent finishes include the following aqueous dispersions: a polyfluoro organic compound prepared by reacting a polyisocyanate with a fluoroalcohol and water disclosed in EP A453641 (Repellent A of the Examples); a blend of a fluoroalkyl citrate-urethane and polymethylmethacrylate disclosed in U.S. Pat. No. 3,923,715 (Repellent B of the Examples); a fluorocarbonylimino biuret obtained by reacting polyisocyanate with a fluoroalcohol and monochlorohydrin disclosed in U.S. Pat. No. 4,958,039 (Repellent C of the Examples); a blend of fluoroalkyl citrate urethane, a fluoroalkyl methacrylate/2-ethylhexyl methacrylate/2-hydroxyethyl methacrylate/N-methylolacrylamide copolymer, a fluoroalkyl methacrylate/lauryl methacrylate/N-methylolacrylamide copolymer, a dimethylaminoethyl methacrylate/acrylic acid copolymer, and a chloroprene/dichlorobutadiene copolymer disclosed in U.S. Pat. No. 4,595,518 (Repellent D of the Examples); copolymers of an alkyl (meth)acrylate/fluoroalkyl (meth)acrylate/vinylidene chloride disclosed in U.S. Pat. No. 5,344,903; and FC-1355 and FC-1367 (both anionic emulsions of fluoroaliphatic polymers, from 3M).

Fluorochemical repellent finishes containing solvents, exemplified by but not limited to an aqueous dispersion of a copolymer disclosed in U.S. Pat. No. 4,742,140 comprising an alkyl acrylate or methacrylate, vinylidene chloride, and a mixture of fluoroalkyl alkyl methacrylates or acrylates (containing some acetone) are also effective in this application, but less preferred due to concerns over flammability hazards and the disposal of organic solvents. The preferred repellent finishes either contain no volatile organic solvents, or no more than about 1%.

Preferred mixed fluorochemical and hydrocarbon repellent finishes include a blend of wax, a diethylaminoethyl methacrylate/hexadecyl methacrylate/octadecyl methacrylate copolymer of the type disclosed in U.S. Pat. No. 4,595,518 and a fluoroalkyl acrylate/hexadecyl methacrylate/octadecyl methacrylate/vinylidene chloride copolymer disclosed in U.S. Pat. No. 4,742,140 (Repellent E of the Examples); a blend of wax, a diethylaminoethyl methacrylate/hexadecyl methacrylate/octadecyl methacrylate copolymer and a fluoroalkyl methacrylate/dodecyl methacrylate copolymer of the type disclosed in U.S. Pat. No. 4,595,518 (Repellent F of the Examples).

Preferred hydrocarbon water-repellent finishes include an aqueous dispersion of: a hydrocarbon wax and a behenic acid ester of melamine (Repellent G of the Examples); a hydrocarbon wax stearyl methacrylate/diethylaminoethyl methacrylate copolymer (Repellent H of the Examples); and Octowax® 321 (an aqueous paraffin wax emulsion, from Tiarco Chemical Co.).

Results obtained using the preferred repellent finishes are described in the Examples. Suitable commercial repellent finishes after application, drying, and curing should not stain or transfer to the underlying substrate (e.g. the carpet or the floor).

Repellent finishes typically have an organic segment of the molecule that binds to the fiber. Those which show oil repellency may also have a fluorocarbon segment. The repellent finishes are selected in part based on the fiber composition. Typical mat fibers can range from relatively hydrophilic fibers such as nylon, intermediate fibers such as polyester, to relatively hydrophobic fibers such as polyolefins. The techniques for matching repellent finishes with fiber composition are well known in the art.

Typically the repellent finish is diluted with water or a suitable solvent such as alcohol for application to the mat, with water being preferred. The necessary dilution is determined by the wet pick-up and the required concentration of active ingredient in the dried and cured mat. The wet pick-up is the amount of repellent finish in the wet mat after application but before drying or curing. The wet pick-up is expressed as a percentage based on the dry fiber. For instance, if a repellent finished mat is to contain 1.5% of the active ingredient and the wet pick-up is 200%, the repellent finish as applied should contain 0.75% active ingredient (100×0.015/2).

The amount of repellent finish, together with the necessary diluent such as water or alcohol that is applied to the underlay, is measured as wet pick-up prior to drying and curing. The wet pick-up applied to the rug underlay fabric will generally be in the range of 20 to 300% by weight, and preferably 50 to 200% by weight, based on the untreated underlay fabric. Typically, commercially available repellent finishes contain about 0.5 to about 40% by weight total active ingredient. In the case of silicones, the total active ingredient may be greater than 40% by weight. In this invention, the amount of active ingredient of repellent finish applied will generally be in the range of about 0.01 to 10% by weight, and preferably 0.05 to 3% by weight, of the active ingredient in the repellent finish based on the underlay mat.

However, it is understood that the amount of repellent finish and active ingredient applied will be adjusted depending on the type and concentration of the repellent, the underlay mat construction and weight, the type of fiber or fibers in the underlay mat, and the type of adhesive application. In any application, it is important that a sufficient amount of repellent finish be uniformly applied to the underlay mat such that the repellent finished underlay is substantially impervious to water or to liquids, according to Test Methods 1 and 2 described below.

The repellent finish may be applied to the underlay mat by various means including foam, spray, dipping, or padding processes, followed by a heat treatment to dry or cure the repellent finish, typically in an oven. The drying temperature, drying temperature profile, and drying time are selected, based on the thermal stability of the fabric and the drying and curing properties of the repellent finish, to be sufficient to accomplish the necessary drying and curing. Control of such drying parameters are well known to those skilled in the art.

It is necessary to ensure that the repellent finish be completely and uniformly applied to the underlay mat, and completely and uniformly dried and cured. Padding, in which the underlay mat is dipped in a bath and the excess repellent finish squeezed off, typically gives excellent and uniform application and is thus the preferred application method. Foam and spray applications, on the other hand, can allow starved or missed areas unless the foam or spray is very carefully applied. Even very small undertreated areas will impair the imperviousness desired. To ensure foam and spray applications are complete, it may be necessary to apply the repellent finish with greater wet pick-up than would be necessary for padding. However, this can require the spray or foam repellent finish to be diluted with extra water compared with the padding process, thus requiring extra drying. For foam and spray applications, a wetting agent may be added to the repellent finish to assist in the complete and uniform application. Suitable wetting agents are exemplified by, but not limited to, "Alkanol"® 6112 (poly(oxyethylene sorbitan monooleate in water/1-decanol), from DuPont). Wetting agents were not necessary in the preferred pad application.

The mat, now substantially impervious to water or liquids, is then coated on one, and preferably both, sides with a suitable adhesive, the adhesive is cured or dried, and one or both surfaces of the repellent finished underlay is protected by an easily released sheet of material, e.g., plastic, paper, or other inexpensive material, to prevent adhesion of the underlay to itself or other surfaces during handling, storage, transportation, and appropriately packaged. The adhesives suitable for underlays, the methods of adhesive application to underlays, and the packaging of underlays are well known to those skilled in the art. While the application of adhesive and packaging of the underlay have been described with respect to certain embodiments, many modifications and changes can be made by those skilled in the art. It is intended that all such modifications are included in the meaning of the term "repellent finished underlay mat" as used herein.

In another embodiment of this invention, the repellent finish may be applied to the underlay mat after the adhesive has been applied and dried or cured. In this embodiment, it is important to ensure the repellent finish does not diminish the adhesive properties of the repellent finished underlay. In a third embodiment of this invention, the repellent finish can be mixed with the adhesive and applied and dried or cured in a single operation. In this embodiment, it is important to ensure the repellent finish and adhesive are mutually compatible and that the repellent treatment does not diminish the adhesive properties of the repellent finished underlay. In a fourth embodiment of this invention, the repellent finish and then the adhesive, or the adhesive and then the repellent finish, can be applied, followed by a single heat treatment to dry and cure both applications.

Although the repellent finishes used in this invention are similar to those used for making a carpet backing substantially impervious to liquids there are significant differences in the application of this technology to underlays. Compared to carpet, an underlay is a thinner, non-woven fabric, without the tufted fibers or the latex binder that secures the tufted fibers in the backing. Consequently, the underlay has much less capacity to absorb liquid spills and to lower the hydrostatic pressure exerted by a liquid spill. These differences require that the repellent finish must be very uniformly applied. For this reason the pad method of application, in which the underlay is immersed in a bath containing the repellent finish at the desired concentration and then squeezed to reduce the wet pick-up to the necessary level, is preferred over spray or foam applications. Spray and foam application, unless carefully controlled, can leave small areas in which the amount of repellent finish active ingredient is inadequate to provide the imperviousness desired.

A second important difference between carpets and underlays is that the repellent finish may be applied to underlays either before or after the application of the adhesive. In the case of carpets, the binding latex is applied before the repellent finish, else the imperviousness of the product is reduced. The binding latex must be worked into the back of the carpet, for instance by a roller, to secure the tufts. A possible explanation of this difference is that working the latex into the carpet after it has been treated with a repellent finish in this manner creates channels for liquids to pass through, thus the imperviousness is impaired.

Test Methods 1 and 2 determine the oil and water imperviousness of the underlay mats, while Test Methods 3 and 4 determine oil and water repellency of the underlay mat, both after the repellent finish has been applied, dried, and cured. The oil repellency rating from Test Method 3 correlates strongly with the desired property of being substantially impervious to liquids as determined by Test Method 1. Similarly, the water repellency rating from Test Method 4 correlates strongly with the desired property of being substantially impervious to water, determined by Test Method 2. The repellency Test Methods 3 and 4 may be easier to use on certain samples. Test Methods 1 and 2 are used for the repellent finished underlay.

The present invention is further illustrated by the Test Methods and Examples below, but these examples should not be considered as limiting the scope of this invention.

TEST METHODS

Test Method 1. Oil Imperviousness

Place the underlay sample, an adhesive side down, on a white absorbent paper towel. Pour 20 ml of S.A.E. 10W30 Motor Oil, adjusted to room temperature (75 +/−5 degrees F) onto the underlay sample through a cylinder of about 4 cm diameter and from a height of about 6 cm to create a circular puddle. Remove the cylinder and let the sample stay undisturbed for 30 minutes. Remove the underlay and measure the diameter of any oil spot on the towel. The sample will be termed as substantially impervious to oil if none or a very slight amount of oil has passed through the underlay sample. Measure the diameter on the paper towel of any oil spot that has passed through the underlay. An oil spot diameter of one inch or less is required for the underlay to be substantially impervious to oil.

Test Method 2. Water Imperviousness

Place the underlay sample, an adhesive side down, on a white absorbent paper towel. Pour 20 ml of water, adjusted to room temperature (75 +/−5 degrees F) onto the underlay sample through a cylinder of about 4 cm diameter and from a height of about 6 cm to create a circular puddle. Remove the cylinder and let the sample stay undisturbed for 30 minutes. Remove the underlay and measure the diameter of any water spot on the towel. The sample will be termed as substantially impervious to water if none or a very slight amount of water has passed through the underlay sample. Measure the diameter on the paper towel of any water spot that has passed through the underlay. A wet spot diameter of one inch or less is required for the underlay to be substantially impervious to water.

Test Method 3. Oil Repellency

AATCC Test Method No. 118–1989

After proper conditioning, the underlay specimen is placed on a flat level surface with an adhesive side down. Three drops of the selected oil or oil mixture are placed on the fabric and left for 30 seconds. If no penetration has occurred, the fabric is judged to "pass" this level of repellency and the next higher numbered oil mixture is tested. The fabric rating is the highest numbered oil mixture that does not wet or penetrate the fabric.

The test oil compositions are:

| AATCC Oil Repellency | |
|---|---|
| Rating Number | Oil Composition |
| 1 | Nujol |
| 2 | 65:35::Nujol:n-hexadecane |
| 3 | n-hexadecane |
| 4 | n-tetradecane |
| 5 | n-dodecane |
| 6 | n-decane |

A rating of 0 indicates no oil repellency; a rating of 3 or higher is desired.

Test Method 4. Water Repellency

DuPont "TEFLON" Standard Test Method No. 311.56

After proper conditioning, the underlay specimen is placed on a flat level surface with an adhesive side down. Three drops of the selected water/isopropanol mixture are placed on the fabric and left for 10 seconds. If no penetration has occurred, the fabric is judged to "pass" this level of repellency and the next higher numbered test liquid is tested. The fabric rating is the highest numbered test liquid that does not wet the fabric.

The water/isopropanol mixtures have the following compositions:

| DuPont Water Repellency | Composition (wt %) | |
|---|---|---|
| Rating Number | Water | Isopropanol |
| 1 | 98 | 2 |
| 2 | 95 | 5 |
| 3 | 90 | 10 |
| 4 | 80 | 20 |
| 5 | 70 | 30 |
| 6 | 60 | 40 |

A rating of 0 indicates no water repellency, a rating of 6 indicates maximum water repellency. A test rating of 3 or higher is desired.

Control—Underlays Without a Repellent finish

A needle-punched, non-woven polyester fabric (approximately 4 oz./square yard) was sprayed with Air Products Pressure Sensitive Adhesive #625 on both the top and bottom face to a total wet pick-up of 20% by weight of adhesive solution. The treated fabric was dried at 270 degrees F for 3 min. resulting in a repellent finished underlay containing 10% by weight of adhesive active ingredient. The following test results were obtained using the Test Methods described above on the fabric before and after the application of the adhesive.

TABLE 1

Tests on Control Underlays Without Repellent finish.

| | Imperviousness (spot diameter, inches) | | Repellency Rating | |
|---|---|---|---|---|
| Underlay Control 1 | Oil (by Test Method 1) | Water (by Test Method 2) | Oil (by Test Method 3) | Water (by Test Method 4) |
| Before Adhesive Appln. | 6 or more | 10 or more | 0 | 0 |
| After Adhesive Appln. | 6 or more | 10 or more | 0 | 0 |

The control underlays failed all tests and are not substantially impervious to either water or oil.

EXAMPLES 1 to 12

Preparation of an Underlay Sequentially Treated With a Repellent finish and Then an Adhesive, and Tests for Oil and Water Permeability A needle-punched, non-woven polyester fabric (approximately 4 oz./square yard) was saturated with the repellent solution indicated in Table 2 and the liquid was reduced by squeezing to 200% by weight of the fabric. The treated fabric was dried at 180 degrees F for 10 min. and cured at 300 degrees F for 3 min. resulting in a fabric with the content of repellent active ingredient indicated in Table 2. The fabric was then sprayed with Air Products Pressure Sensitive Adhesive//625 on both the top and bottom face to a total wet pick-up of 20% by weight of solution. The treated fabric was dried at 270 degrees F for 3 min. to give a fabric containing 10% by weight of adhesive active ingredient. The following test results were obtained using the Test Methods described above.

TABLE 2

| Tests on the Underlays Prepared in Example 1–12 | | | | | | |
|---|---|---|---|---|---|---|
| | | Active Ingredient | Imperviousness (spot diameter, inches) | | Repellency Rating | |
| Example | Repellent | based on initial fabric (% by weight) | Oil (by Test Method 1) | Water (by Test Method 2) | Oil (by Test Method 3) | Water (by Test Method 4) |
| | | Fluorochemical Water-Repellent Finishes | | | | |
| 1 | A | 3.0% | 0 | 0 | 6 | 6 |
| 2 | B | 1.4% | 0 | 0 | 6 | 4 |
| 3 | C | 1.0% | 0 | 0 | 6 | 4 |
| 4 | D | 0.30% | 0 | 0 | 6 | 6 |
| 5 | B | 3.0% | 0 | 0 | 6 | 5 |
| 6 | FC-1355 | 1.5% | 0 | 0 | 5 | 5 |
| 7 | FC-1367 | 1.5% | 0 | 0 | 6 | 5 |
| | | Mixed Fluorochemical and Hydrocarbon Water-Repellent Finishes | | | | |
| 8 | E | 2.4% | 0 | 0 | 6 | 6 |
| 9 | F | 0.96% | 0 | 0 | 6 | 6 |
| | | Hydrocarbon Water-Repellent Finish | | | | |
| 10 | G | 1.2% | 6 | 0 | 0 | 5 |
| 11 | H | 1.2% | 6 | 0 | 0 | 4 |
| 12 | Octowax 321 | 2.5% | 7 | 0 | 0 | 5 |

The tests show the underlay treated with Repellents G and H as well as Octowax 321 were substantially impervious to water, all other treated underlays were substantially impervious to oil and water.

EXAMPLES 13–19

Preparation of an Underlay Sequentially Treated With an Adhesive and Then a Repellent finish, and Tests for Oil and Water Permeability.

A needle-punched, non-woven polyester fabric (approximately 4 oz./square yard) was sprayed with Air Products Pressure Sensitive Adhesive #625 on both the top and bottom face to a total wet pick-up of 20% by weight of solution. The treated fabric was dried at 270 degrees F for 3 min. to give a fabric containing 10% by weight of adhesive active ingredient. The fabric was then saturated with a water-repellent solution and the liquid was reduced by squeezing to 200% by weight of the fabric. The treated fabric was dried at 180 degrees F for 10 min. and cured at 300 degrees F for 3 min. resulting in a fabric with the content of repellent active ingredient indicated in Table 3. The following test results were obtained using the Test Methods described above.

TABLE 3

| Tests on the Underlays Prepared in Example 13–19 | | | | | | |
|---|---|---|---|---|---|---|
| | | Active Ingredient | Imperviousness (spot diameter, inches) | | Repellency Rating | |
| Example | Repellent | based on initial fabric (% by weight) | Oil (by Test Method 1) | Water (by Test Method 2) | Oil (by Test Method 3) | Water (by Test Method 4) |
| | | Fluorochemical Water-Repellent Finishes | | | | |
| 13 | A | 3.0% | 0 | 0 | 6 | 5 |
| 14 | C | 1.0% | 0 | 0 | 6 | 5 |
| 15 | D | 0.30% | 0 | 0 | 6 | 6 |
| 16 | B | 3.0% | 0 | 0 | 6 | 6 |
| | | Mixed Fluorochemical and Hydrocarbon Water-Repellent Finishes | | | | |
| 17 | E | 1.2% | 0 | 0 | 6 | 6 |
| 18 | F | 0.96% | 0 | 0 | 6 | 6 |
| | | Hydrocarbon Water-Repellent Finish | | | | |
| 19 | G | 1.2% | 6 | 0 | 0 | 4 |

The tests show that the underlay treated with Repellent G was substantially impervious to water, all other treated underlays were substantially impervious to oil and water.

EXAMPLES 20–22

Preparation of Underlays Sequentially Treated With a Repellent finish and Then an Adhesive, Followed by a Combined Drying and Curing Treatment, and Tests for Oil and Water Permeability.

A needle-punched, non-woven polyester fabric (approximately 4 oz./square yard) was saturated with the indicated repellent solution and the liquid was reduced by squeezing to 200% by weight of the fabric. The fabric was then sprayed with Air Products Pressure Sensitive Adhesive #625 on both the top and bottom face to a total wet pick-up of 200% by weight of solution. The treated fabric was dried at 270 degrees F for 3 min. to give a fabric containing about 25% by weight of adhesive active ingredient and with the content of repellent active ingredient indicated in Table 4. The following test results were obtained using the Test Methods described above.

TABLE 4

| Tests on the Underlays Prepared in Example 20–22 | | | | | | |
|---|---|---|---|---|---|---|
| | | Active Ingredient | Imperviousness spot diameter, inches) | | Repellency Rating | |
| Example | Repellent | based on initial fabric (% by weight) | Oil (by Test Method 1) | Water (by Test Method 2) | Oil (by Test Method 3) | Water (by Test Method 4) |
| | | Fluorochemical Repellent Finish | | | | |
| 20 | D | 0.30% | 0 | 0 | 6 | 6 |
| | | Mixed Fluorochemical and Hydrocarbon Repellent Finishes | | | | |
| 21 | F | 0.95% | 6 | 0 | 2 | 6 |
| | | Hydrocarbon Water-Repellent Finish | | | | |
| 22 | G | 2.5% | 6 | 0 | 0 | 5 |

The tests show the underlays treated with Repellents F and G were substantially impervious to water. The underlay treated with Repellent D was substantially impervious to oil and water.

We claim:

1. A carpet underlay comprising a fibrous non-woven substrate composed of natural or synthetic fibers having a coating of adhesive on one or both sides, and said substrate having in or on it a repellent finish which makes said substrate substantially impervious to water or other liquids, whereby 20 ml of water or oil poured on said substrate from a height of 6 cm makes no wet spot after 30 minutes, or a wet spot having a diameter of no more than 2.54 cm, on a paper towel located directly beneath the location on said substrate on which said water or oil has been poured.

2. The carpet underlay of claim 1 wherein said fibers comprise cotton, wool, jute, nylon, polyolefin, polyester, acrylic polymers, or mixtures of the same.

3. The carpet underlay of claim 1 wherein said repellent finishes comprise fluorochemicals, silicones, wax emulsions, naturally occurring oils, alkylacrylate resins, or hydrophobic alkylmethacrylates resins, or mixture of the same.

4. The carpet underlay of claim 3 wherein said fluorochemicals are selected from the group consisting of polyvinylidene fluoride; polytetrafluoroethylene; perfluoroalkylethyl acrylates; perfluoroalkylethyl methacrylates; mixtures of the same; and blends of the foregoing compounds and polymers with polyalkyl acrylates, polyalkylmethacrylates, wax emulsions, and copolymers of vinylidene chloride, vinylidene fluoride, tetrafluoroethylene, perfluoroalkylethyl acrylates, and perfluoroalkylethyl methacrylates.

5. The carpet underlay of claim 3 wherein said fluorochemical is selected from the group consisting of fluoroalkyl citrate urethane, a fluoroalkyl methacrylate/2-ethylhexyl methacrylate/2-hydroxyethyl methacrylate/N-methylolacrylamide copolymer, a fluoroalkyl methacrylate/lauryl methacrylate/N-metholacrylamide copolymer, a dimethylaminoethyl methacrylate/acrylic acid copolymer, a chloroprene/dichlorobutadiene copolymer, and a blend thereof.

6. The carpet underlay of claim 1 wherein said repellent finish active ingredient content of said substrate is from 0.01 to 10% by weight.

7. The carpet underlay of claim 1 wherein said repellent finish active ingredient content of said substrate is from 0.05 to 3% by weight.

8. A process for rendering carpet or rug underlays substantially impervious to liquids which comprises applying a repellent finish in or on a carpet underlay in an amount effective to make said underlay substantially impervious to liquids, whereby 20 ml of water or oil poured on said substrate from a height of 6 cm makes no wet spot, or a wet spot having a diameter of no more than 2.54 cm, on a paper towel located directly beneath the location on said substrate on which said water or oil has been poured.

9. The process of claim 8 wherein said underlay comprises fibers of cotton, wool, jute, nylon, polyolefin, polyester, acrylic polymers, or mixtures of the same.

10. The process of claim 8 wherein said repellent finishes comprise fluorochemicals, silicones, wax emulsions, naturally occurring oils, hydrophobic alkylacrylate resins, or hydrophobic alkylmethacrylates resins, or mixture of the same.

11. The process of claim 10 wherein said fluorochemicals are selected from the group consisting of polyvinylidene fluoride; polytetrafluoroethylene; perfluoroalkylethyl acrylates; perfluoroalkylethyl methacrylates; mixtures of the same; and blends of the foregoing compounds and polymers with polyalkyl acrylates, polyalkylmethacrylates, modified wax emulsions, and copolymers of vinylidene chloride, vinylidene fluoride, tetrafluoroethylene, perfluoroalkylethyl acrylates, and perfluoroalkylethyl methacrylates.

12. The process of claim 10 wherein said fluorochemical is selected from the group consisting of fluoroalkyl citrate urethane, a fluoroalkyl methacrylate/2-ethylhexyl methacrylate/2-hydroxyethyl methacrylate/N-methylolacrylamide copolymer, a fluoroalkyl methacrylate/lauryl methacrylate/N-metholacrylamide copolymer, a dimethylaminoethyl methacrylate/acrylic acid copolymer, a chloroprene/dichlorobutadiene copolymer, and a blend thereof.

13. The process of claim 8 wherein the amount of said repellent finish active ingredient applied in or on said substrate is from 0.01 to 10% by weight.

14. The process of claim 8 wherein the amount of said repellent finish active ingredient applied in or on said substrate is from 0.05 to 3% by weight.

* * * * *